US006928999B1

(12) United States Patent
Hslao et al.

(10) Patent No.: US 6,928,999 B1
(45) Date of Patent: Aug. 16, 2005

(54) PAINTBALL GUN ANTI-BLOCKING DEVICE

(76) Inventors: Lien-Chao Hslao, 3F., No. 11-2, Alley 30, Lane 165, Yong-an Rd., Yongkang City, Tainan County (TW); Yue-Shiu Hung, No. 12, Gongming S. 2nd Rd., Annan District, Tainan City (TW)

( * ) Notice: Subject to any disclaimer, the term of this patent is extended or adjusted under 35 U.S.C. 154(b) by 0 days.

(21) Appl. No.: 10/805,830

(22) Filed: Mar. 22, 2004

(51) Int. Cl.[7] ..... F41B 11/00
(52) U.S. Cl. ..... 124/32; 124/73
(58) Field of Search ..... 124/32, 73, 74, 124/76

(56) References Cited

U.S. PATENT DOCUMENTS 5,727,538 A * 3/1998 Ellis ..... 124/77
5,967,133 A * 10/1999 Gardner, Jr. ..... 124/77
6,520,172 B2 * 2/2003 Perrone ..... 124/74
6,523,534 B2 * 2/2003 Juan ..... 124/32
6,568,381 B2 * 5/2003 Chang ..... 124/32
6,637,421 B2 * 10/2003 Smith et al. ..... 124/77

* cited by examiner

*Primary Examiner*—John A. Ricci
(74) *Attorney, Agent, or Firm*—Alan D. Kamrath; Nikolai & Mersereau, P.A.

(57) ABSTRACT

A paintball gun anti-blocking device includes a first, infra-red receiver and emitter disposed near the bottom of the inner wall of the gun tube to detect when the paintball enters the normal shooting position. A second infra-red receiver and emitter are positioned relative to the trigger as to detect if the trigger is pressed to the shooting position.

6 Claims, 5 Drawing Sheets

PAINTBALL GUN ANTI-BLOCKING DEVICE

BACKGROUND OF THE INVENTION

1. Field of the Invention

This invention is to provide a paintball gun anti-blocking device to proceed the actuation of such paintball gun, wherein an infra-red receiver and infra-red emitter inside a gun tube and also above and below a trigger have to be on the status of "ON" and messages thereof sent to a substrate of a gun body so that the bolt sleeved in the gun tube is enabled to proceed with the motion of shooting the paintball.

2. Description of Related Art

The manufacturers develop to manufacture paintball gun, assemblies in order to achieve shooting of a paintball safely. Specifically, a detection and touching switch is usually assembled on a trigger of the gun or inside a gun tube. One current form of assembly of said detection and touching switch is using a micro-actuating switch assembled on the predetermined position or orientation of the trigger of the gun. The micro-actuating switch is touched while the trigger is pressed so as to transfer the message onto a substrate of the gun body so as to make a bolt inside the gun tube shoot the paintball which falls into the normal shooting position. However, the restore force of such micro-actuating switch is by a spring which tended to be elastic tired after being used one period of time. Another current form of assembly is a sensor inside the gun tube near the bottom such that when the paintball falls into the normal position of shooting, the messages could be transferred onto the substrate of the gun body and in cooperation with the trigger to shoot the paintball normally.

SUMMARY OF THE INVENTION

This invention is to provide an anti-blocking device sensing if the paintball enters into a normal shooting position so that a user, when shooting with the paintball gun, could detect exactly if the paintball is in the normal shooting position for shooting and sensing the actuation of the trigger. An infra-red receiver and infra-red emitter inside the gun tube and above and below the trigger, respectively, transfer the message to the substrate of the gun body to be the basis of actuation for the gun bolt to shoot the paintball.

The object of this invention is to provide a first infra-red receiver and emitter near the bottom of an inner wall of a gun tube to detect if a paintball enters into the normal position. When electronically interconnecting, the first infra-red receiver and emitter will form a status of "OFF". If blocked by a paintball, the first infra-red receiver and emitter will form a status of "ON" which means it is O.K. to shoot. A second infra-red receiver and emitter connected to the substrate are provided on opposite positions of the trigger to detect if the trigger has been pressed. An "OFF" message is formed when the second infra-red receiver and emitter are interconnecting, while an "ON" message is formed to show shoot-able status when the second infra-red receiver and emitter are blocked. Thereby, actuation of the bolt to shoot the paintball by the paintball gun is based upon the first and second infra-red receivers and emitters.

The above and other objects, features and advantages of the present invention will become apparent from the following detailed description taken with the accompanying drawings.

DETAILED DESCRIPTION OF THE PREFERRED EMBODIMENTS

Figure 1:
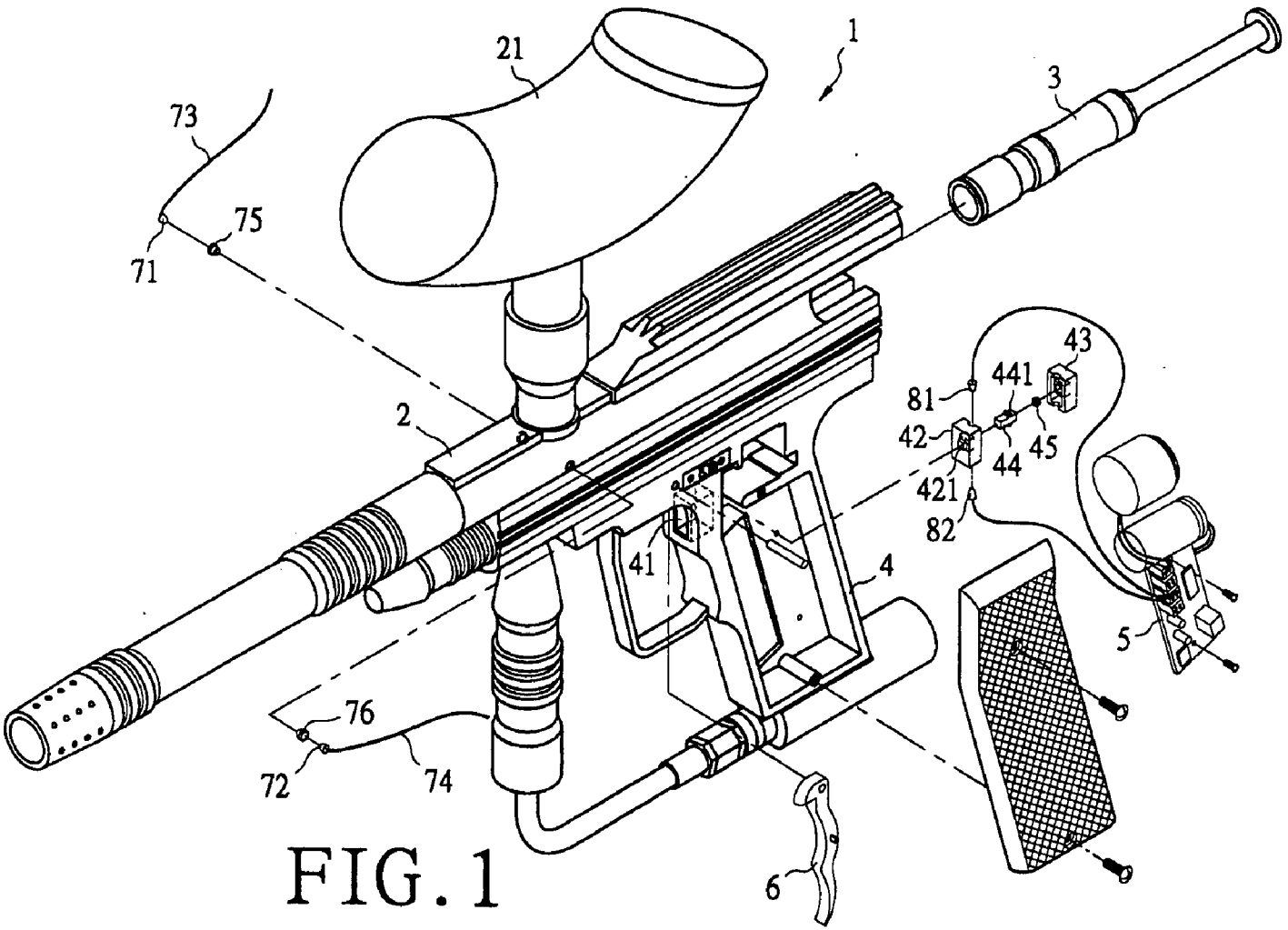
FIG. 1 is an exploded view of a preferred embodiment of a paintball gun of this invention.
Figure 2:
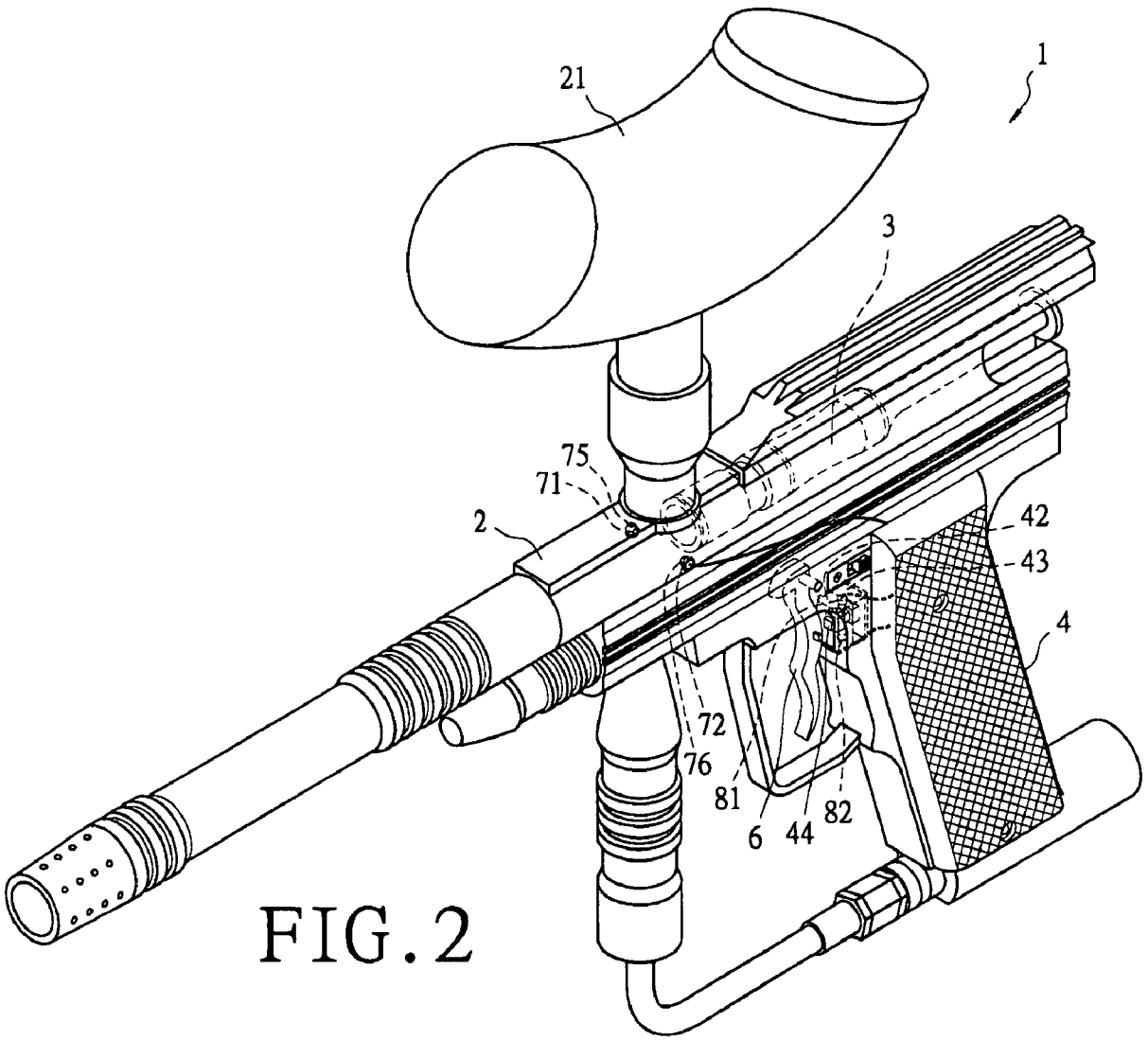
FIG. 2 is a perspective view of the paintball gun of this invention.
Figure 4:
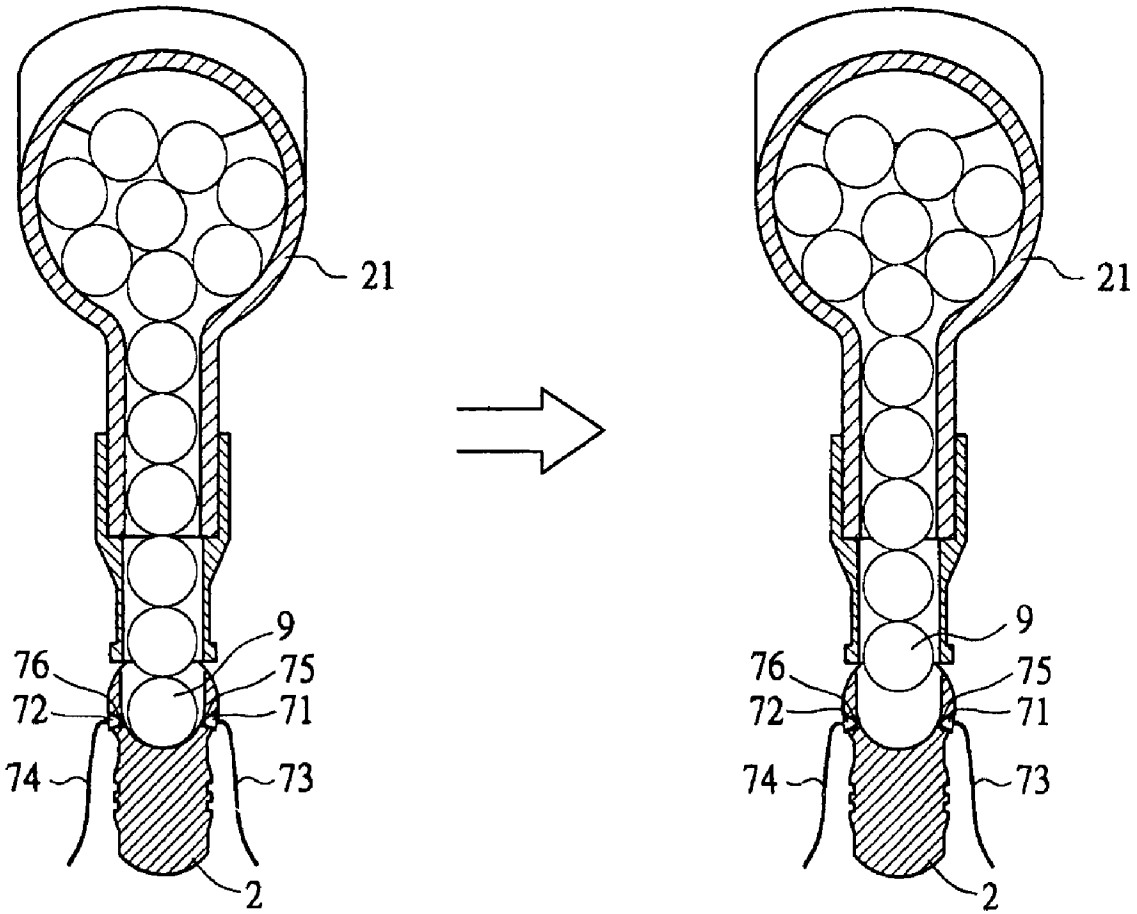
FIG. 4 is a cross sectional view of the paintball gun according to section line 11—11 of FIG. 3.

This invention provides an anti-blocking device for a paintball gun 1. Referring to FIGS. 1 and 2, an infra-red receiver 71 and an infra-red emitter 72 covered by light-filtration mirrors 75 and 76 on their outer peripheries are mounted on both sides of an inner tube wall of a gun tube 2. A bolt 3 of the gun tube 2 allocates paintballs in the paintball gun 1. The infra-red receiver 71 and the infra-red emitter 72 are preferably installed on the position near one-third of the height of the lower portion of the inner tube wall of the gun tube 2, as illustrated at the left of FIG. 4. One end of conducting wires 73 and 74 of the receiver 71 and the emitter 72 are connected onto a substrate 5 assembled inside a gun body 4. Fore and rear bundle bodies 42 and 43 are inserted into a holding cavity 41 of the gun body 4 on a position contacting with a trigger 6 for controlling the actuation of the bolt 3 inside the rear-section of the inner tube wall of the gun tube 2. A pin body 44 is movably contained between the fore and rear bundle bodies 42 and 43. The pin body 44 has a hole 441 penetrating through the top and the bottom of the pin body 44 on a predetermined section. An elastic element 45 is clipped between one end of the pin body 44 and the rear bundle body 43 such that the pin body 44 is elastically pushed outwardly by the elastic element 45. The other end of the pin body 44 penetrates a hole 421 of the fore bundle body 42. An infra-red receiver 81 and an infra-red emitter 82 connected to the substrate 5 are respectively settled above and below the hole 441 of the pin body 44 while the trigger 6 is un-pressed.

Figure 3:
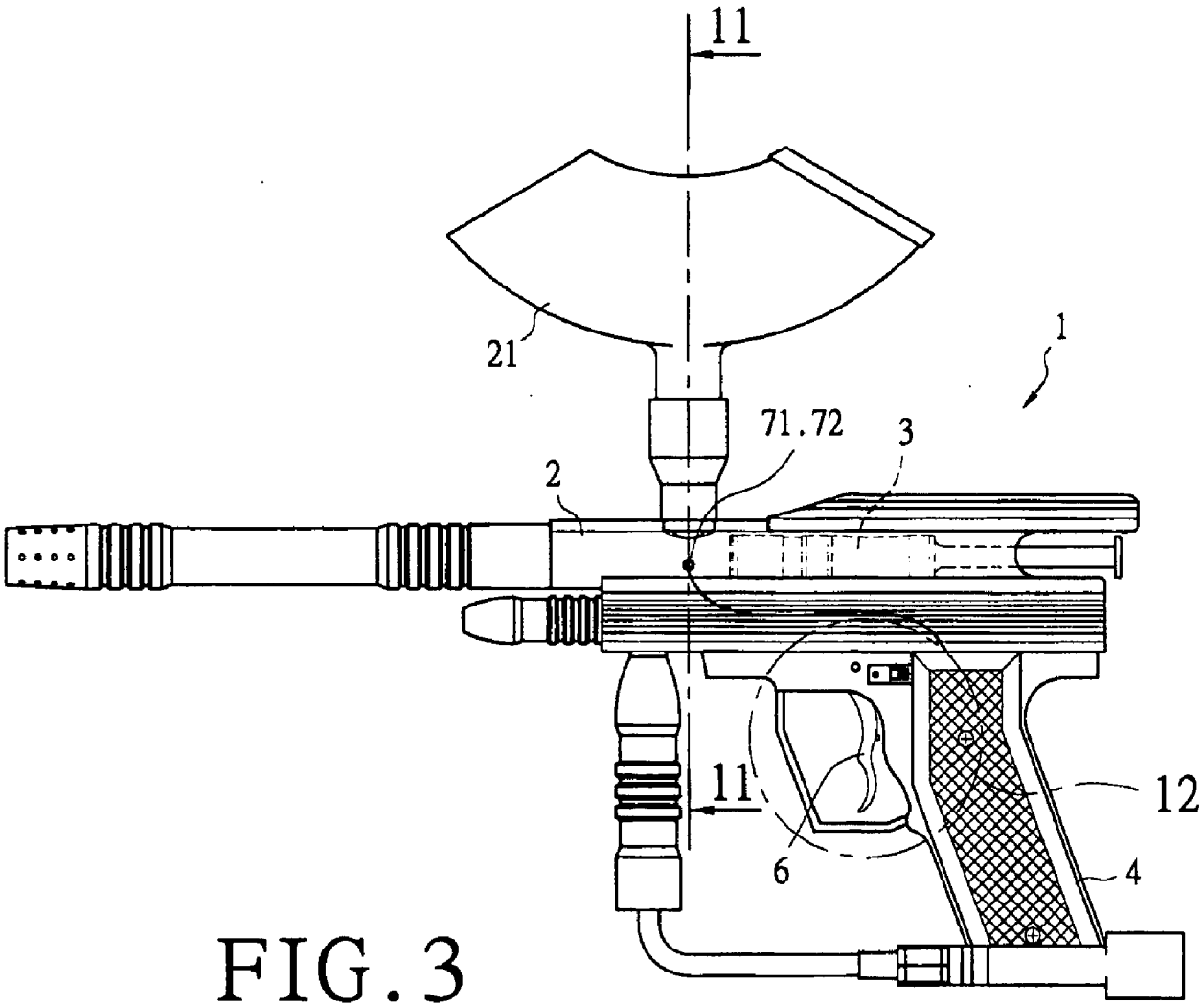
FIG. 3 is a side view of the paintball gun of this invention.
Figure 5:
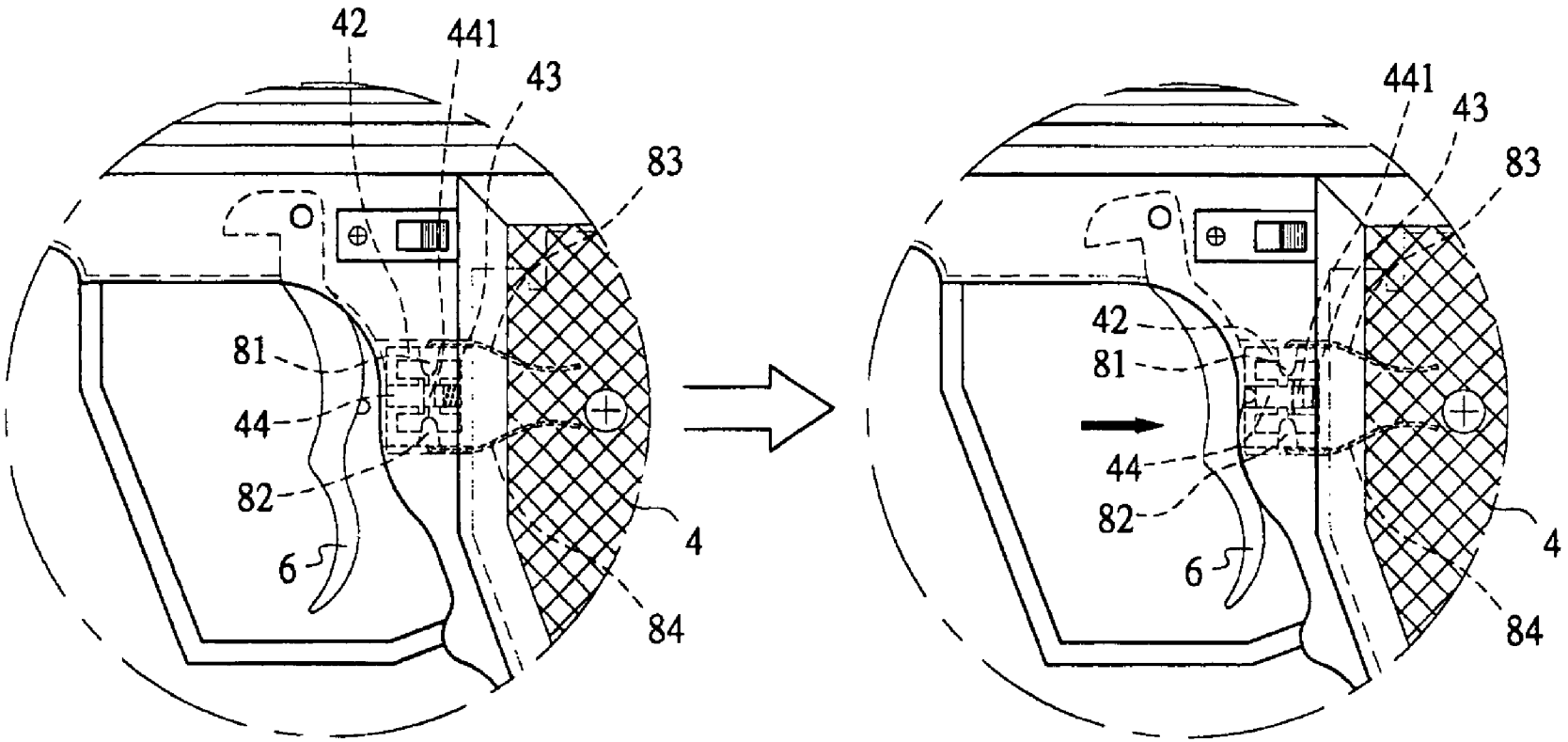
FIG. 5 is an enlarged detailed view of encircled area 12 of FIG. 3.

For shooting the paintball gun 1 in which the gun tube 2 and the trigger 6 are respectively assembled with infra-red receivers and infra-red emitters and referring to FIG. 3, paintballs 9 are filled inside a loader 21. As illustrated at the left of FIG. 4, the paintballs 9 in the loader 21 will fall into the normal shooting position of the gun tube 2 in sequence. Thus, the infra-red receiver 71 and infra-red emitter 72 assembled on both sides of the inner tube wall of the gun tube 2 are shielded by the paintball 9 in the gun tube 2 to form the status of "ON". Said message will be transferred onto the inner substrate 5 of the gun body 4 through the conducting wires 73 and 74. When the trigger 6 is pressed and as illustrated at the right of FIG. 5, the infra-red receiver 81 and infra-red emitter 82 assembled above and below the trigger 6 are shielded by the pin body 44 to form the status of "ON". Said message will be transferred onto the substrate 5 inside the gun body 4 through the conducting wires 83 and 84. With the "ON" status of receivers 71 and 82 and emitters 72 and 82, the bolt 3 sleeved in the gun tube 2 will proceed shooting the paintball 9 in the normal shooting position.

In addition, when the paintball 9 inside the loader 21 does not fall into the normal shooting position in the gun tube 2 successfully, as illustrated at the right of FIG. 4, the infra-red receiver 71 and infra-red emitter 72 assembled on both sides of the inner wall of the gun tube 2 are interconnected by light to form the status of "OFF". Said message will be transferred onto the substrate 5 of the gun body 4 through the conducting wires 73 and 74. Thus, even if the user presses and/or triggers the trigger 6, it is impossible to permit the bolt 3 in the gun tube 2 to proceed shooting.

The paintball gun anti-blocking device according to this invention can be provided with a third switch on the substrate 5 inside the gun body 4 so as to cut-off the function of the infra-red receiver 71 and infra-red emitter 72 on both sides of the inner wall of the gun tube 2. Thus, when the user cleans the paintball gun 1 it is possible to press and trigger the trigger 6 to drive the bolt 3 in the gun tube 2 to proceed with the motion of shooting.

Additionally, when the trigger 6 is pressed, the movable pin body 44 of the gun body 4 against the trigger 6 according to this invention, blocks the infra-red receiver 81 and infra-red emitter 82 to form the status of "ON". Alternatively, when the trigger 6 is not pressed and triggered and the pin body 44 moves outwardly by the elastic member 45, the hole 441 penetrating through the top and the bottom of the pin body 44 are aligned with and the infra-red receiver 81 and infra-red emitter 82 are interconnected by light to turn the status of "OFF". Said message will be transferred onto the inner substrate 5 of the gun body 4 as the basis of shooting by the bolt 3 in the gun tube 2.

While the invention herein disclosed has been described by means of specific embodiments, numerous modifications and variations could be made thereto by those skilled in the art without departing from the scope and spirit of the invention set forth in the claims.

What is claimed is:

1. A paintball gun comprising, in combination:

a gun body;

a gun tube secured to the gun body;

a bolt sleeved inside the gun tube;

a trigger moveable relative to the gun body between an un-pressed position and a shooting position;

a substrate assembled in the gun body for controlling movement of the bolt in the gun tube due to pressing the trigger to shoot a paintball located in the gun tube;

a first infra-red receiver and emitter provided on the gun tube, with the first infra-red receiver and emitter being in an "ON" status when the paintball is located between the first infra-red receiver and emitter, with the first infra-red receiver and emitter being in an "OFF" status when the paintball is not located between the first infra-red receiver and emitter; and a second infra-red receiver and emitter provided on the gun body relative to the trigger, with the second infra-red receiver and emitter being in an "ON" status when the trigger is in the shooting position and being in an "OFF" status when the trigger is in the un-pressed position, with movement of the bolt in the gun tube being blocked when either of the first and second infra-red receivers and emitters are in the "OFF" position and being allowed when both of the first and second infra-red receivers and emitters are in the "ON" position.

2. The paintball gun as claimed in claim 1, further comprising, in combination: light-filtration mirrors covering the first infra-red receiver and emitter, with the gun tube having an inner wall, with the first infra-red receiver and emitter located in the inner wall near the bolt.

3. The paintball gun as claimed in claim 2 further comprising, in combination: a pin body moveable by the trigger, with the pin body having a hole, with the second infra-red receiver and emitter located on opposite sides of the pin body, with the second infra-red receiver and emitter being interconnected through the hole when the trigger is in the shooting position and blocked by the pin body when the trigger is in the un-pressed position.

4. The paintball gun as claimed in claim 3 further comprising, in combination: fore and rear bundle bodies, with the second infra-red receiver and emitter sandwiched between the fore and rear bundle bodies, with the pin body being movably sleeved in the fore and rear bundle bodies intermediate the second infra-red receiver and emitter; and a spring sandwiched between the pin body and the rear bundle body, with the pin body extending through an access hole in the fore bundle body, with the pin body being confined and isolated from outside light by the fore and rear bundle bodies.

5. The paintball gun as claimed in claim 1 further comprising, in combination: a pin body moveable by the trigger, with the pin body having a hole, with the second infra-red receiver and emitter located on opposite sides of the pin body, with the second infra-red receiver and emitter being interconnected through the hole when the trigger is in the shooting position and blocked by the pin body when the trigger is in the un-pressed position.

6. The paintball gun as claimed in claim 5 further comprising, in combination: fore and rear bundle bodies, with the second infra-red receiver and emitter sandwiched between the fore and rear bundle bodies, with the pin body being movably sleeved in the fore and rear bundle bodies intermediate the second infra-red receiver and emitter; and a spring sandwiched between the pin body and the rear bundle body, with the pin body extending through an access hole in the fore bundle body, with the pin body being confined and isolated from outside light by the fore and rear bundle bodies.

* * * * *